US008454084B2

(12) United States Patent
Lah

(10) Patent No.: US 8,454,084 B2
(45) Date of Patent: Jun. 4, 2013

(54) PORTABLE CHAIR

(75) Inventor: Jeh-Kun Lah, Seoul (KR)

(73) Assignee: Jeh-Kun Lah, Jongno-gu, Seoul (KR)

( * ) Notice: Subject to any disclaimer, the term of this patent is extended or adjusted under 35 U.S.C. 154(b) by 0 days.

(21) Appl. No.: 13/277,252

(22) Filed: Oct. 20, 2011

(65) Prior Publication Data

US 2012/0104805 A1 May 3, 2012

(30) Foreign Application Priority Data

Oct. 28, 2010 (KR) ..... 10-2010-0105917

(51) Int. Cl.
*A47C 4/00* (2006.01)
*A47C 7/00* (2006.01)

(52) U.S. Cl.
USPC ..... 297/16.2; 297/440.11

(58) Field of Classification Search
USPC ..... 297/16.2, 16.1, 17, 440.11
See application file for complete search history.

(56) References Cited

U.S. PATENT DOCUMENTS 5,054,849 A 10/1991 Hoff
5,499,857 A * 3/1996 Lynch, Jr. ..... 297/16.2
5,709,428 A 1/1998 Hugghins
6,164,726 A * 12/2000 Reeves et al. ..... 297/452.63
7,384,097 B2 * 6/2008 Park et al. ..... 297/45
8,205,934 B2 * 6/2012 Homans ..... 297/16.2
2009/0230736 A1 9/2009 Homans

FOREIGN PATENT DOCUMENTS

JP 3009595 4/1995

* cited by examiner

*Primary Examiner* — Milton Nelson, Jr.
(74) *Attorney, Agent, or Firm* — Nixon Peabody LLP; Jeffrey L. Costellia

(57) ABSTRACT

The portable chair of the disclosure includes: hubs respectively installed at both left and right sides of the chair; a central support frame connecting both left and right hubs; front and rear leg frames respectively having base ends separably coupled to the lower front and rear outer peripheral surfaces of the respective hubs and respectively having free ends disposed in a manner of radially extending toward the ground surface; front and rear pole frames respectively having base ends separably coupled to the upper front and rear outer peripheral surfaces of the respective hubs and respectively having free ends disposed in a manner of radially extending toward the sky; and a fabric sheet coupled to the free ends of the front and rear pole frames. The structural rigidity is excellent, and the chair may land on the ground surface in a stable posture.

9 Claims, 13 Drawing Sheets

PORTABLE CHAIR

CROSS-REFERENCE TO RELATED APPLICATION

This application claims priority to Korean Patent Application No. 10-2010-0105917, filed on Oct. 28, 2010, and all the benefits accruing therefrom under 35 U.S.C. §119, the contents of which in its entirety are herein incorporated by reference.

BACKGROUND

1. Field

The present disclosure relates to a portable chair, and more particularly, to a portable chair which is easily folded and unfolded, has a small volume, and improves stability and comfortability.

2. Description of the Related Art

A portable chair has been provided in various forms such as a foldable chair, a chair with a back support portion, a chair without a back support portion, and the like in accordance with the types or the purposes of outdoor activities such as camping or fishing.

Various kinds of examples of the related art concerned with the portable chair are shown in FIG. 1 which is one of the accompanied drawings.

Among the portable chairs shown in FIG. 1, a 'normal chair 1' and a 'normal chair 2' are provided in a form in which frames intersect each other through central hinges, and include a fabric sheet (a support plate) which is flattened when the chair is unfolded. Such a portable chair may be easily folded and unfolded and has a comparatively small volume when being folded, and thus there is an advantage in that the portable chair may be easily carried. However, since the fabric sheet is small and flat, it is difficult for the user to sit thereon for a long period of time due to low comfortability. Furthermore, since the chair has a structure in which the intersection of the frames receiving the concentrated load is perforated and a hinge pin is inserted thereinto, the frame intersection portion is weak in structure.

Among the portable chairs shown in FIG. 1, a 'normal chair 3' has a form in which the 'normal chair 1' is provided with a back support portion. The structure of the portable chair cannot make up for the weakness of the 'normal chair 1' except for the point in which the user may lean against the back support portion thereof.

Among the portable chairs shown in FIG. 1, a 'normal chair 4' has a form in which the sheet and the back support portion are foldable. Such a portable chair may be easily folded. However, it is difficult to carry the chair since the volume of the folded chair is large, and it is difficult to use the chair in the outdoor place when the ground surface is wet or uneven since the chair has no leg.

Among the portable chairs shown in FIG. 1, a 'normal chair 5' has excellent comfortability since it forms a shape of a general chair with a general back support portion. However, it is difficult to carry the chair since the volume of the folded chair is large, and the structure becomes complicated in that the hinge structure may be employed for many points. In addition, there is a concern that the chair is not comfortably operated or is not operated at the time of using the chair at the outdoor place when foreign matters intrude into the hinge portions.

SUMMARY

The present disclosure is directed to providing a portable chair that strengthens the strength of the existing portable chair and makes up for the weakness thereof.

Specifically, the present disclosure is directed to providing a portable chair that is easily folded and unfolded, is simply carried due to a small volume thereof in a folded state, and has excellent support rigidity and minimizes a structural weak portion by employing a structure in which frames are fitted into a central hub.

The present disclosure is also directed to providing a portable chair that helps a user to feel comfortable in a seated state for a long period of time by wrapping the left and right sides of the butt of the user as well as the above-described advantages.

The present disclosure is also directed to providing a portable chair that stably lands on even a place where a ground surface is not even by providing a rotatable hub to which frames are fitted.

In one aspect, there is provided a portable chair including: hubs respectively installed at both left and right sides of the chair; a central support frame connecting both left and right hubs to each other; front and rear leg frames respectively having base ends separably coupled to the lower front and rear outer peripheral surfaces of the respective hubs and respectively having free ends disposed in the form of radially extending toward the ground surface; front and rear pole frames respectively having base ends separably coupled to the upper front and rear outer peripheral surfaces of the respective hubs and respectively having free ends disposed in the form of radially extending toward the sky; and a fabric sheet coupled to the free ends of the front and rear pole frames.

Each of the front leg frame, the rear leg frame, the front pole frame, and the rear pole frame may be connected to any one frame other than itself through one elastic string passing through the hubs.

The front leg frame, the rear leg frame, the front pole frame, and the rear pole frame may be all formed as a hollow tube, the elastic string may be disposed so as to pass through the inside of the respective frames and the hubs, and binding stoppers bound with the ends of the elastic string may be coupled to the free ends of the respective frames.

The outer peripheral surface of the hub may be provided with coupling holes respectively corresponding to the base ends of the front and rear leg frames and the front and rear pole frames, and the base ends of the front and rear leg frames and the front and rear pole frames may be separably inserted into the respective coupling holes.

The left and right hubs may be connected to both ends of the central support frame through an elastic string.

The central support frame may be formed as a hollow tube, the elastic string may be disposed so as to pass through the inside of the central support frame and both hubs, and binding stoppers bound with the ends of the elastic string may be coupled to the outer ends of both hubs.

Coupling holes may be provided in the inner surface sides of both hubs, and both ends of the central support frame may be rotatably inserted into the coupling holes.

The front and rear leg frames may be formed to be shorter than the front and rear pole frames, and one or more frames of the front pole frame and the rear pole frame may be configured in a form in which two or more unit pole frames are connected to each other in the axial direction.

The fabric sheet may include pockets into which the free ends of the front and rear pole frames are separably inserted.

The fabric sheet may include a seating surface portion curved and depressed in a form of supporting and wrapping a butt, a thigh, and a waist of a user sitting thereon and side surface portions blocking the left and right sides of the seating surface portion.

BRIEF DESCRIPTION OF THE DRAWINGS

The above and other aspects, features and advantages of the disclosed exemplary embodiments will be more apparent from the following detailed description taken in conjunction with the accompanying drawings in which.

DETAILED DESCRIPTION

Figure 1:
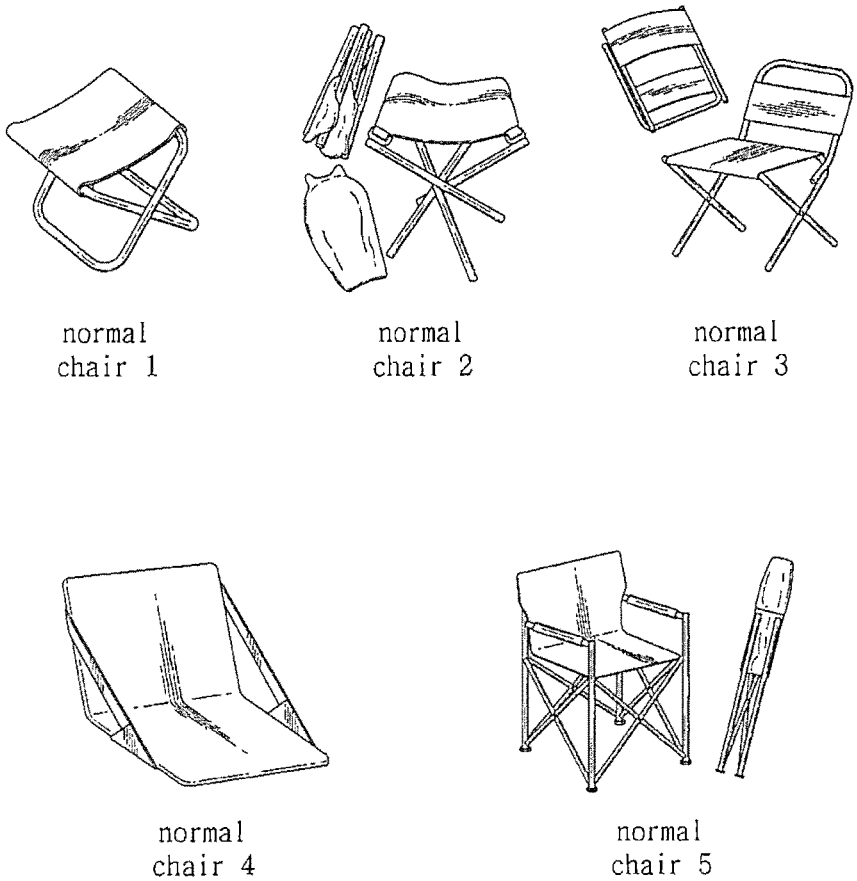
FIG. 1 (PRIOR ART)
FIG. 1 is a diagram illustrating various kinds of examples of an existing portable chair.

Exemplary embodiments now will be described more fully hereinafter with reference to the accompanying drawings, in which exemplary embodiments are shown. The present disclosure may, however, be embodied in many different forms and should not be construed as limited to the exemplary embodiments set forth therein. Rather, these exemplary embodiments are provided so that the present disclosure will be thorough and complete, and will fully convey the scope of the present disclosure to those skilled in the art. In the description, details of well-known features and techniques may be omitted to avoid unnecessarily obscuring the presented embodiments.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. Furthermore, the use of the terms a, an, etc. does not denote a limitation of quantity, but rather denotes the presence of at least one of the referenced item. The use of the terms "first", "second", and the like does not imply any particular order, but they are included to identify individual elements. Moreover, the use of the terms first, second, etc. does not denote any order or importance, but rather the terms first, second, etc. are used to distinguish one element from another. It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In the drawings, like reference numerals denote like elements. The shape, size and regions, and the like, of the drawing may be exaggerated for clarity.

Hereinafter, an exemplary embodiment of the disclosure will be described in more detail by referring to the accompanying drawings.

Figure 2:
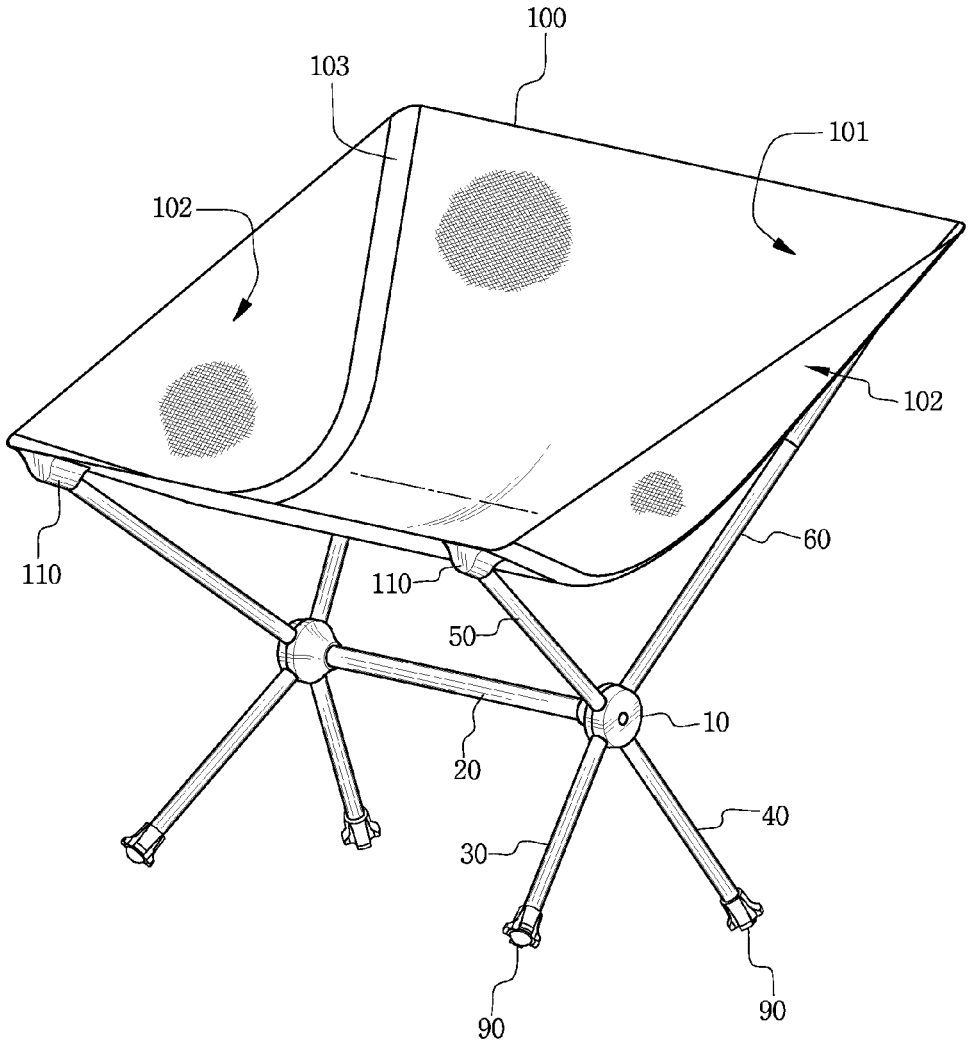
FIG. 2 is a perspective view illustrating a portable chair according to the disclosure.
Figure 3:
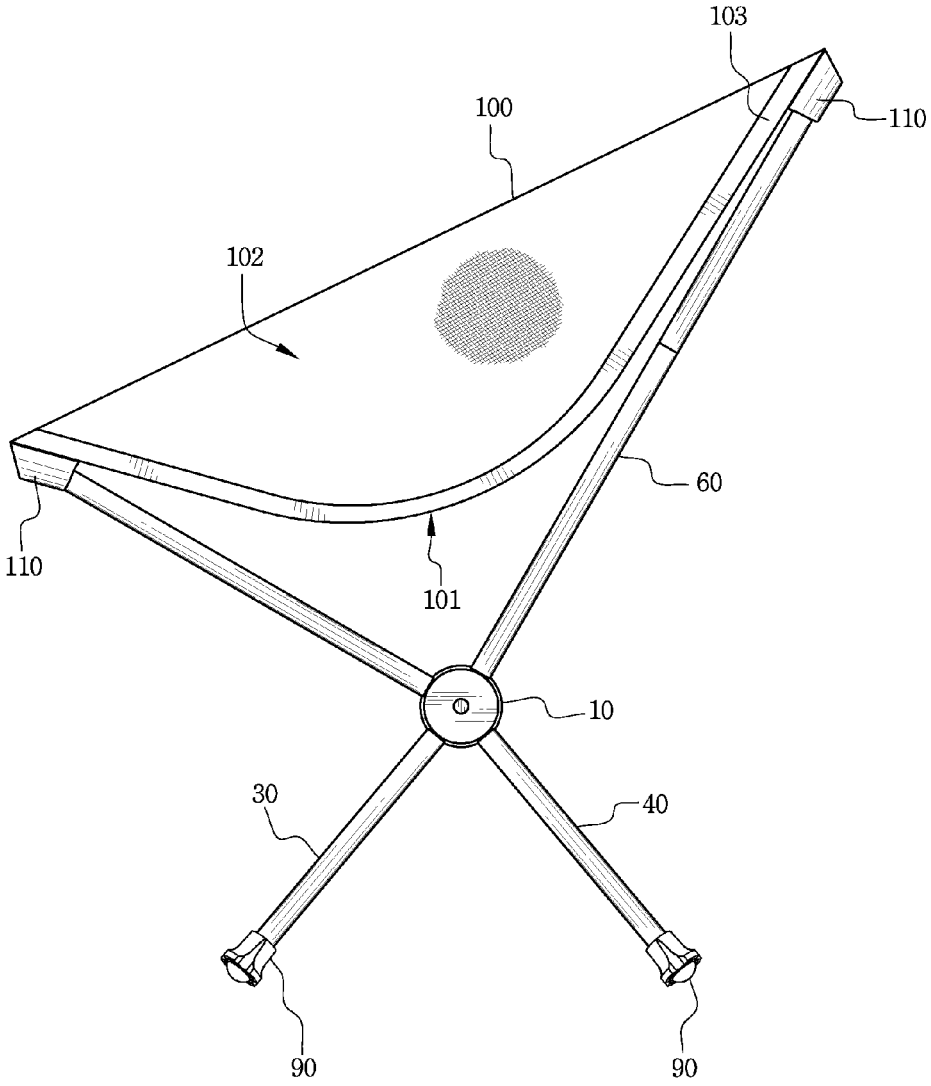
FIG. 3 is a side view illustrating the portable chair according to the disclosure.

FIGS. 2 and 3 show the entire shape of the portable chair according to the disclosure.

As shown in FIGS. 2 and 3, the portable chair according to the disclosure includes: hubs 10 that are respectively installed at both left and right sides of the chair; a central support frame 20 that connects both left and right hubs 10 to each other; front and rear leg frames 30 and 40 of which base ends are separably coupled to the lower front and rear outer peripheral surfaces of the respective hubs 10 and free ends are disposed in the form of radially extending toward the ground surface; front and rear pole frames 50 and 60 of which base ends are separably coupled to the upper front and rear outer peripheral surfaces of the respective hubs 10 and free ends are disposed in the form of radially extending toward the sky; and a fabric sheet 100 that is coupled to the free ends of the front and rear pole frames 50 and 60.

In the embodiment, the fabric sheet 100 includes pockets 110 which enable the free ends of the front and rear pole frames 50 and 60 to be separably fitted thereinto. The attaching and detaching operation between the fabric sheet 100 and the pole frames 50 and 60 may be realized in various forms using a band, a clip, an attaching fabric, and the like.

The fabric sheet 100 has a narrow area and a simple structure, which is a form capable of comfortably supporting and wrapping user's butt, thigh, and waist. For this structure, the fabric sheet 100 includes a seating surface portion 101 that is curved and depressed in the form of supporting and wrapping the butt, the thigh, and the waist of the seated user and side surface portions 102 that blocks the left and right sides of the seating surface portion 101.

The fabric sheet 100 may be made in such a form that the seating surface portion 101 and the side surface portions 102 are formed as separated pieces and they are sewed to each other through connecting bands 103.

Since the portable chair of the disclosure may be folded while the front and rear leg frames 30 and 40 and the front and rear pole frames 50 and 60 are separated from the hubs 10 and the fabric sheet 100 is separated therefrom, the volume of the portable chair is small, so that the portable chair may be conveniently carried.

Furthermore, since the portable chair of the disclosure is formed in a structure in which the base ends of the frames 30, 40, 50, and 60 are radially coupled to the two central hubs 10 provided at both left and right sides of the chair so as to support the load and the hubs 10 are also supported by the central support frame 20 instead of the existing structure in which the intersections of the frames are perforated and hinge pins are inserted thereinto, which is weak in the structure, the portable chair may maintain a posture in which there is no concern about the degradation of the rigidity of the frame and the structural rigidity is excellent and stable.

When the frames 20, 30, 40, 50, and 60 are formed of a highly elastic aluminum alloy, the rigidity and the elasticity of the alloy material may be used. For this reason, the structural rigidity of the frame may further improve and the frame may be formed to be thin and light in weight. In this case, when the front and rear leg frames 30 and 40 receiving the load are formed to be short, the bending rigidity increases, so that the frame may be formed to be thinner and lighter in weight.

The fabric sheet 100 may support not only the butt and the thigh of the user using the seating surface portion 101 thereof but also the waist of the user in a leaning state, thereby maintaining excellent comfortability and stability for a long period of time. In addition, since the side surface portion 102 is higher than the left and right butts and the side surface of the thigh by a predetermined extent, not only the practical stability but also the mental stability may be obtained.

Furthermore, the volume of the folded portable chair may be further decreased since even the fabric sheet 100 may be separated, and the installation and the separation of the portable chair may be simply carried out due to the structure in which the free ends of the front and rear pole frames 50 and 60 are fitted into the pockets 110.

FIGS. 4 to 9 are diagrams more specifically illustrating the structure of the frame according to the disclosure.

Figure 4:
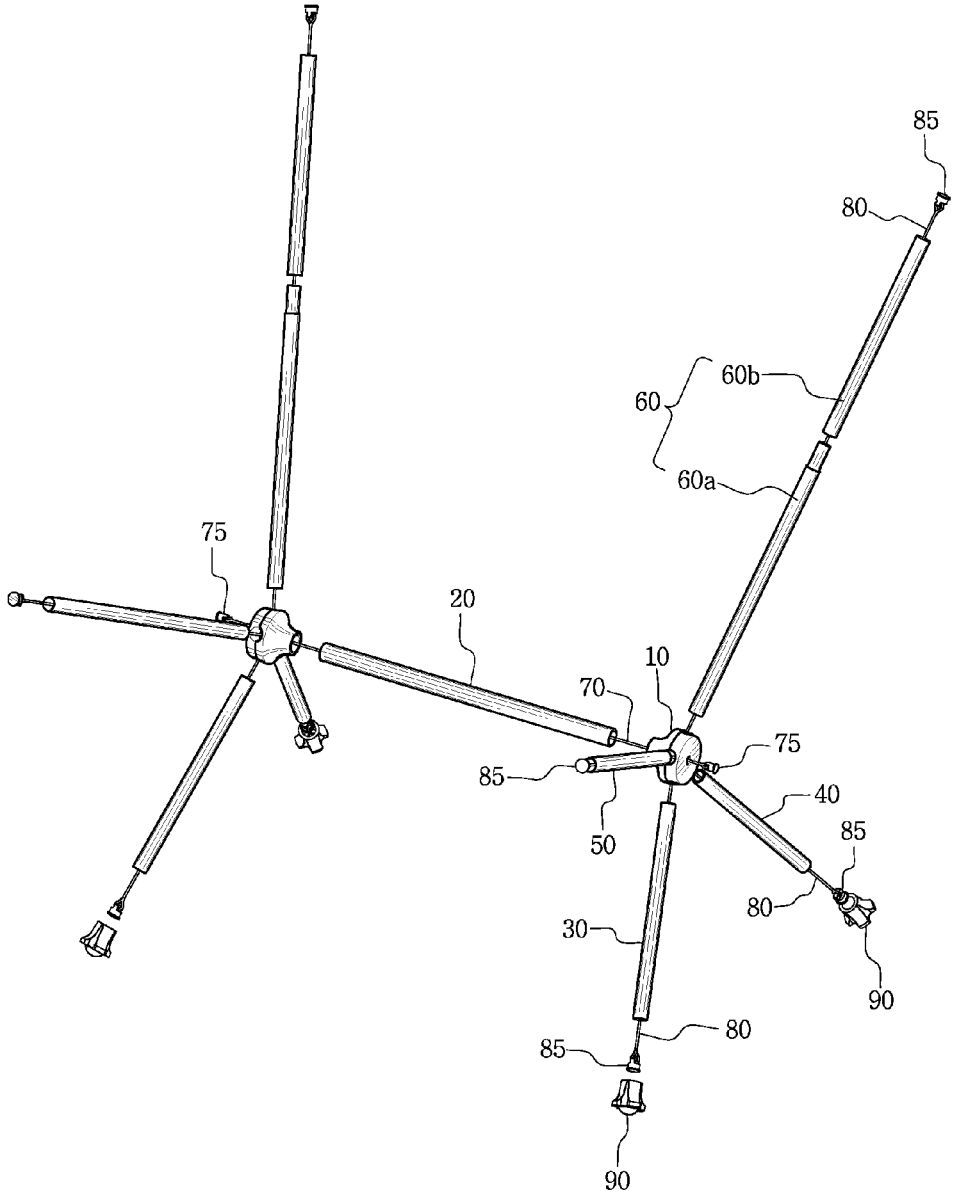
FIG. 4 is a perspective view illustrating a state where frames of the portable chair according to the disclosure are separated from each other.
Figure 5:
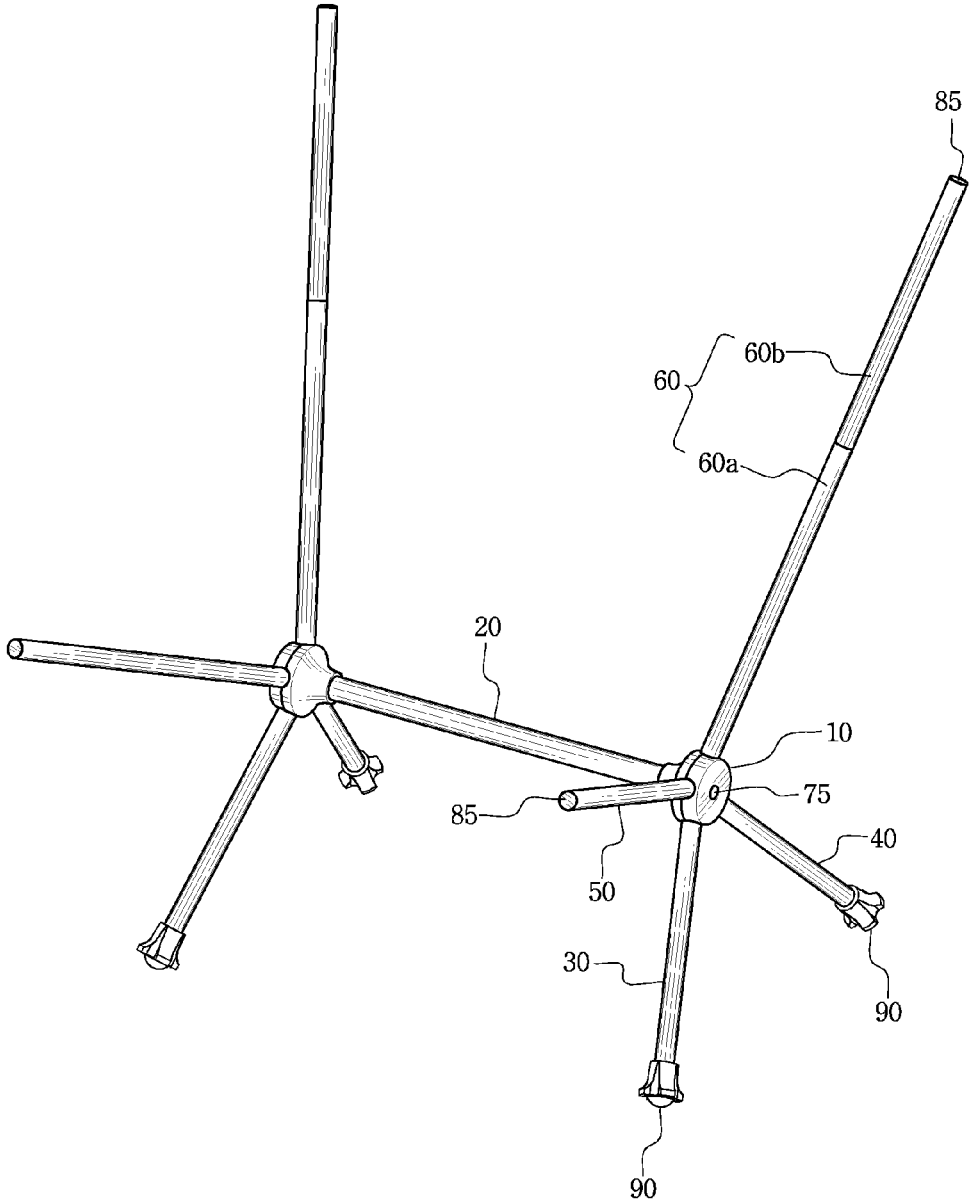
FIG. 5 is a perspective view illustrating a state where the frames of the portable chair according to the disclosure are assembled to each other.
Figure 6:
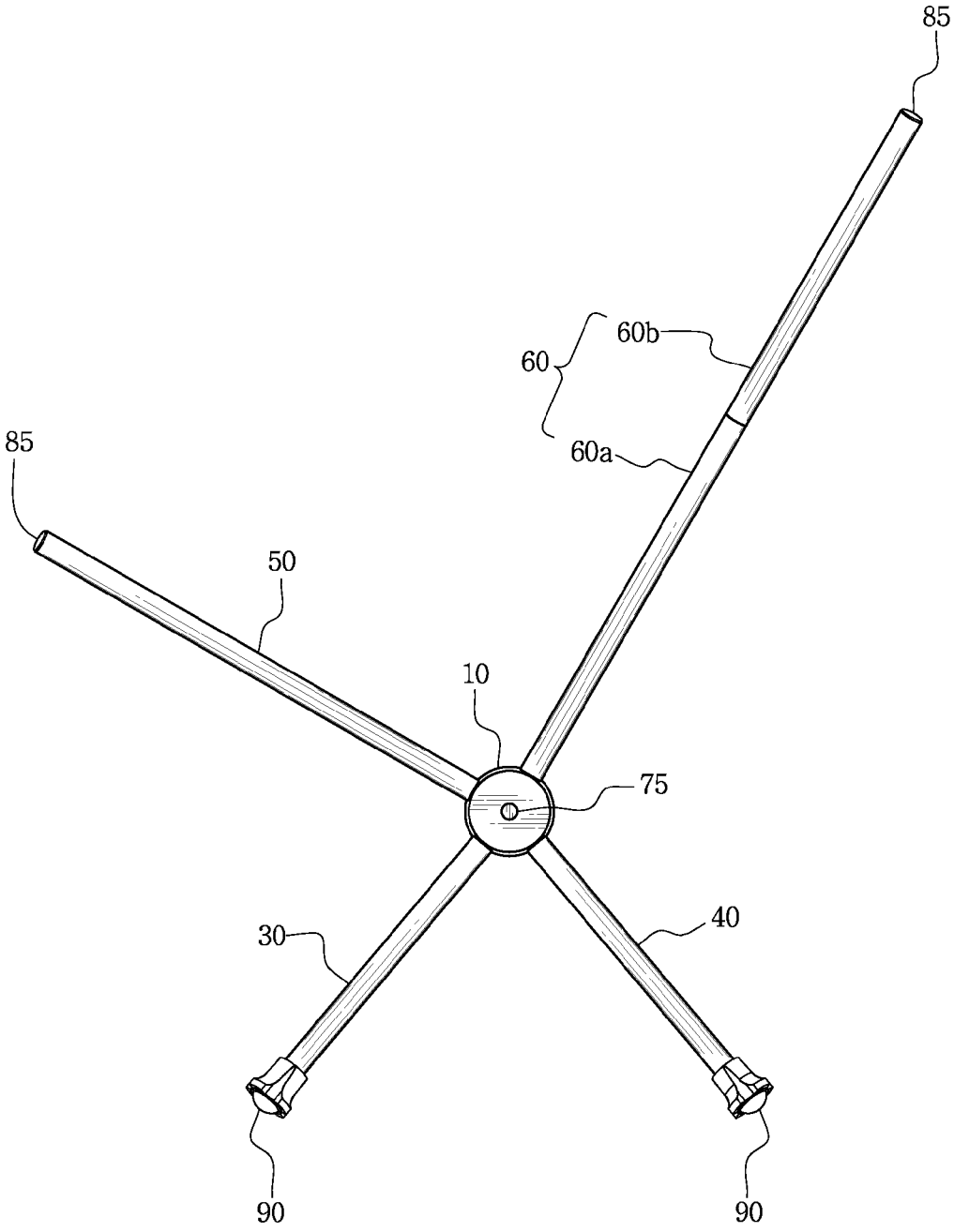
FIG. 6 is a side view illustrating a state where the frames of the portable chair according to the disclosure are assembled to each other.

As shown in FIGS. 4 to 6, the central support frame 20 is fitted into both left and right hubs 10. The base ends of the leg frames 30 and 40 and the pole frames 50 and 60 are fitted into the outer peripheral surfaces of the hubs 10 in a shaft/hole coupling manner.

Both ends of the central support frame 20 are connected to both left and right hubs 10 through an elastic string 70. In the same manner, the front and rear leg frames 30 and 40 and the front and rear pole frames 50 and 60 are connected to the hub 10 through an elastic string 80. Since the elastic strings 70 and 80 act to pull the frames toward the hubs 10, the frames may be prevented from being arbitrarily separated from the hub 10 at the time of installing the portable chair, and the frames may be prevented from being lost and may be evenly arranged at the time of folding the portable chair.

In order to facilitate the connection of the elastic strings 70 and 80, binding stoppers 75 and 85 are employed. The ends of the elastic strings 70 and 80 are tied to the binding stoppers 75 and 85. The binding stoppers 75 for the central support frame 20 are inserted into the outer ends of the hubs 10. The binding stoppers 85 for the leg frames 30 and 40 and the pole frames 50 and 60 are respectively coupled to the free ends of the frames 30, 40, 50, and 60.

In the case where the central support frame 20 is formed in a hollow tube shape, the elastic string 70 is disposed so as to pass through the inside of the central support frame 20 and both hubs 10, and the binding stoppers 75 are inserted into the outer ends of the hubs 10.

In the case where the leg frames 30 and 40 and the pole frames 50 and 60 are formed in a hollow tube shape, the elastic string 80 is disposed so as to pass through the inside of the frames 30, 40, 50, and 60, and the binding stopper 85 is inserted into the free ends of the frames 30, 40, 50, and 60.

Meanwhile, the front pole frame 50, the rear pole frame 60, or both frames 50 and 60 may be all configured in a form in which two or more unit pole frames are connected to each other in the axial direction. In the embodiment, only the rear pole frame 60 is configured in a form in which two separated unit pole frames 60*a* and 60*b* are coupled to each other in the axial direction.

It is desirable to cover the free ends landing on the ground surface in the front and rear support frames 30 and 40 with protection caps 90. Although not shown in the drawings, the protection caps may be coupled to the free ends of the front and rear pole frames 50 and 60. The protection caps 90 enable the frames 30 and 40 to reliably land on the ground surface and protect the free ends of the frames 30 and 40 so as to prevent the deformation and the damage thereof. In addition, the protection caps prevent dirt or foreign matters from intruding through the free ends of the frame.

Figure 7:
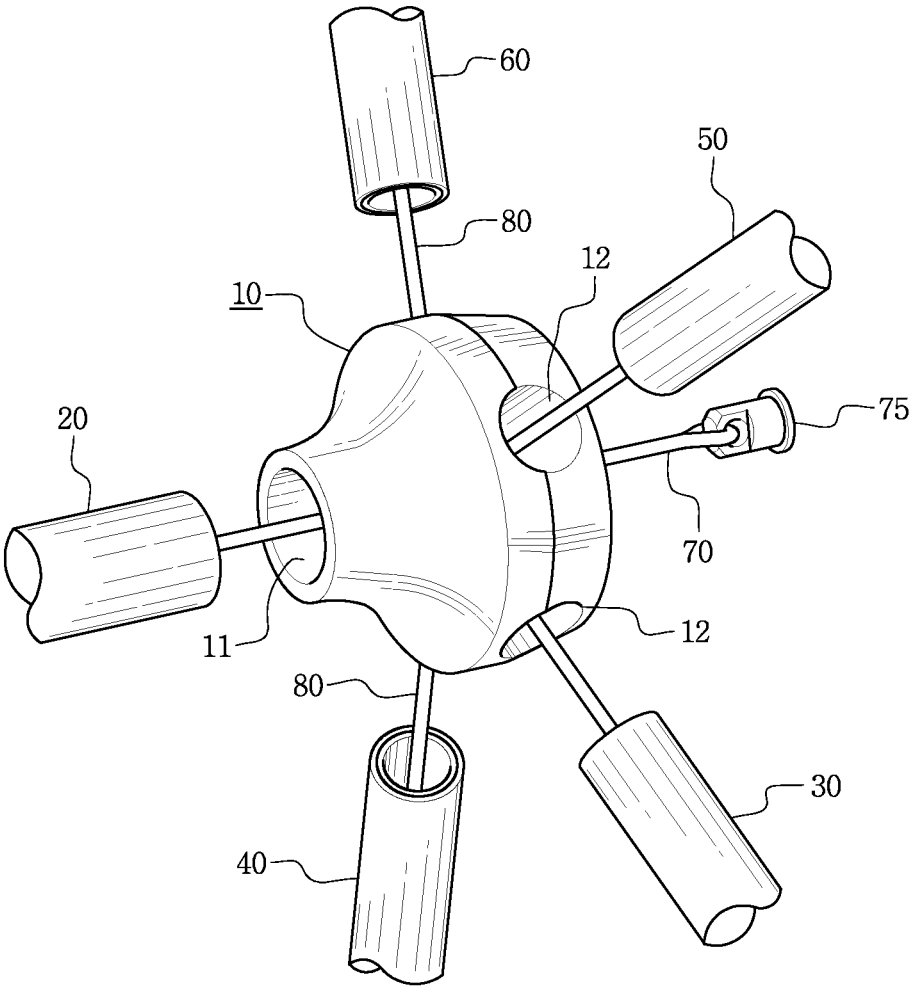
FIG. 7 is a perspective view specifically illustrating the connection structure between the frames and the hubs of the portable chair according to the disclosure.
Figure 8:
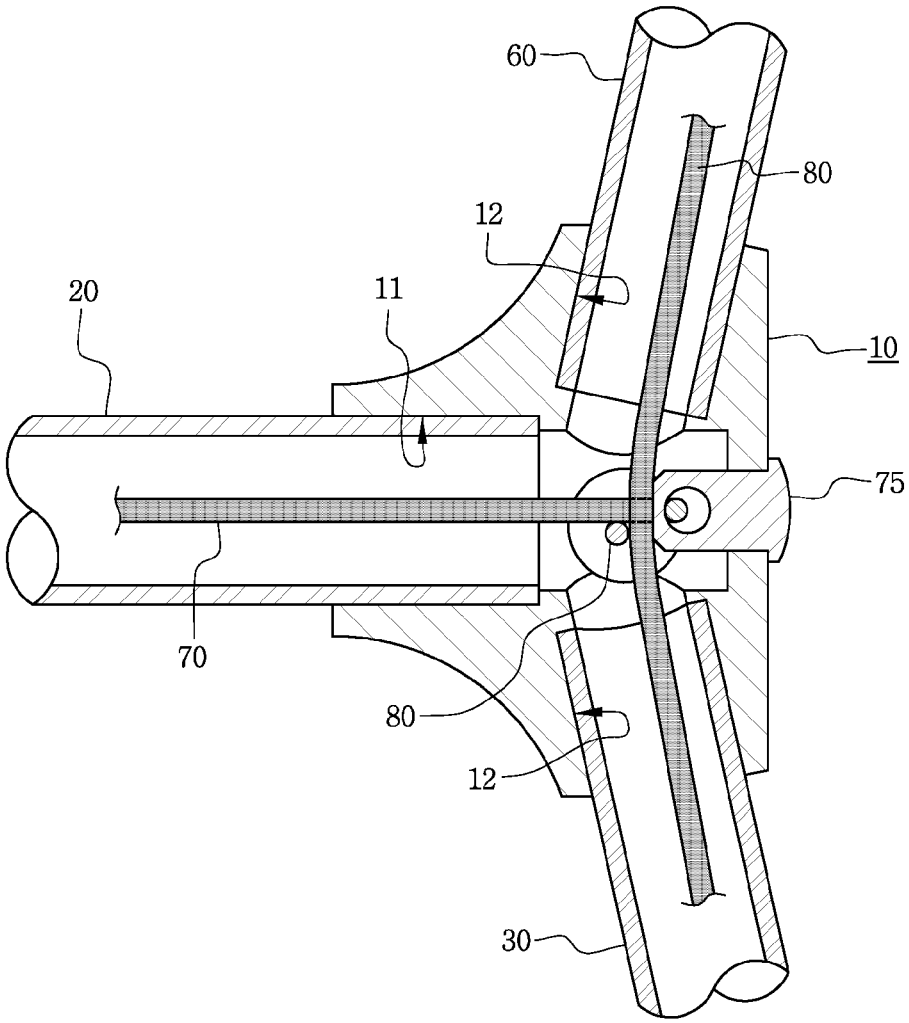
FIG. 8 is a front cross-sectional view of FIG. 7.
Figure 9:
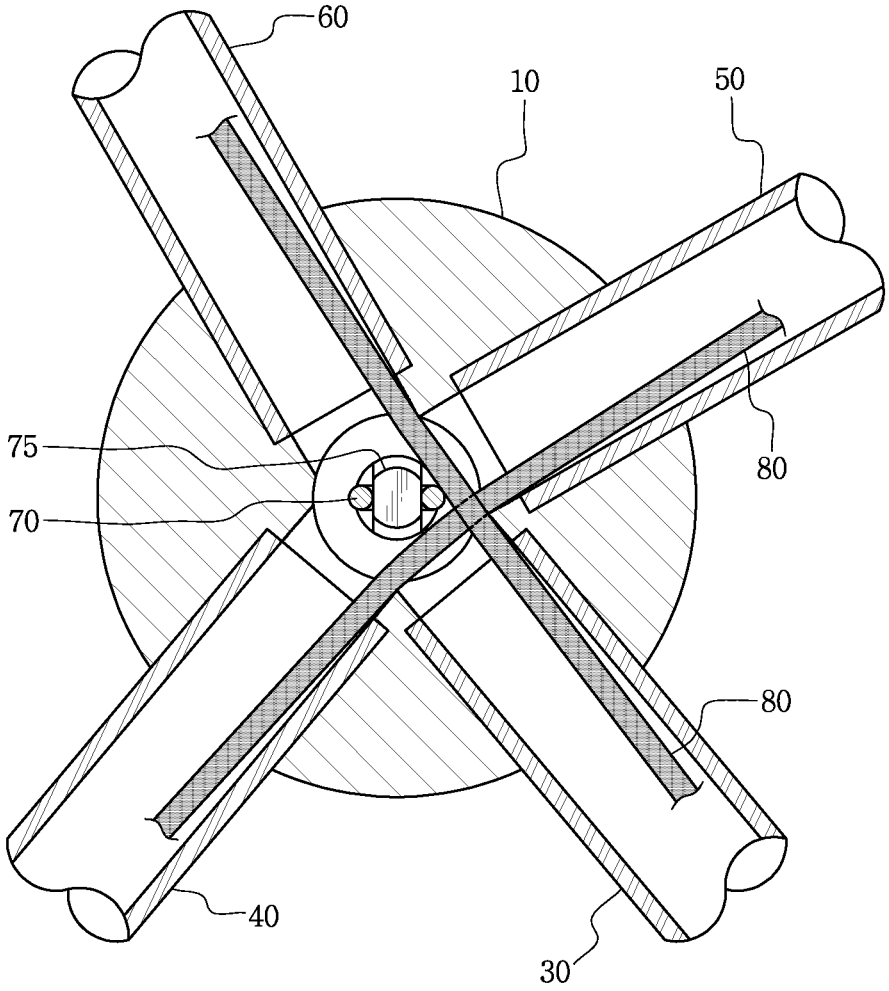
FIG. 9 is a side cross-sectional view of FIG. 7.

FIGS. 7 to 9 specifically illustrate the structure in which the frames 20, 30, 40, 50, and 60 are separably coupled to the hubs 10 and the installation shape of the elastic strings 70 and 80.

As shown in FIGS. 7 to 9, the inner surface side of the hub 10 is provided with a coupling hole 11, and the end of the central support frame 20 is rotatably inserted into the coupling hole 11. The elastic string 70 passes through the coupling hole 11 of the hub 10. Even when the end of the central support frame 20 is rotatably inserted into the coupling hole 11 of the hub 10, since the elastic string 70 pulls the hubs 10 provided at both sides of the portable chair inward, there is no concern in that the hubs 10 are arbitrarily separated from the central support frame 20.

When the end of the central support frame 20 is coupled to a coupling hole 11 of the hub 10 so as to be rotatable (that is, to an extent in which the end may be rotated by the user's force), both left and right hubs 10 may be respectively rotated. That is, both hubs 10 may be rotated at different angles with respect to the central support frame 20. In this way, when there is a difference in height of the ground surface where both front and rear leg frames 30 and 40 land or both left and right leg frames 30 and 40 land, both hubs 10 appropriately rotate with respect to the central support frame 20, so that the leg frames 30 and 40 all stably land on the ground surface.

Furthermore, the outer peripheral surface of the hub 10 is provided with radial coupling holes 12, and the base ends of the front and rear leg frames 30 and 40 and the front and rear pole frames 50 and 60 are separably inserted into the coupling holes 12. Even when the base ends of the leg frames 30 and 40 and the pole frames 50 and 60 are rotatably inserted into the coupling holes 12 of the hubs 10, since the elastic string 80 pulls the frames 30, 40, 50, and 60 toward the central hub 10, there is no need to worry about the arbitrary separation of the frames 30, 40, 50, and 60 from the hubs 10.

In the case where the leg frames 30 and 40 and the pole frames 50 and 60 are separably inserted into the hubs 10 through the insertion holes 12 and the leg frames 30 and 40 and the pole frames 50 and 60 are formed as a hollow tube, the elastic string 80 may be disposed so as to pass through the inside of the respective frames 30, 40, 50, and 60 and the hubs 10.

Each of the front leg frame 30, the rear leg frame 40, the front pole frame 50, and the rear pole frame 60 may be connected to any one frame other than itself through one elastic string 80 passing through the hubs 10. That is, in the frames 30, 40, 50, and 60, arbitrary two frames adjacent to each other in the circumferential direction or facing each other in the diagonal direction may be connected to each other through one elastic string 80 passing through the hubs 10. In FIGS. 8 and 9, the frames facing each other, that is, the front leg frame 30 and the rear pole frame 60 facing each other and the rear leg frame 40 and the front pole frame 50 facing each other are connected to each other through one elastic string 80. Unlike this, the frames adjacent to each other in the circumferential direction 30-40/50-60 or 30-50/40-60 may be connected to each other.

With the above-described configuration, since the elastic string 80 does not need to be tied or fixed to the hub 10, the elastic string 80 may be easily installed and be simplified in the structure.

Figure 10:
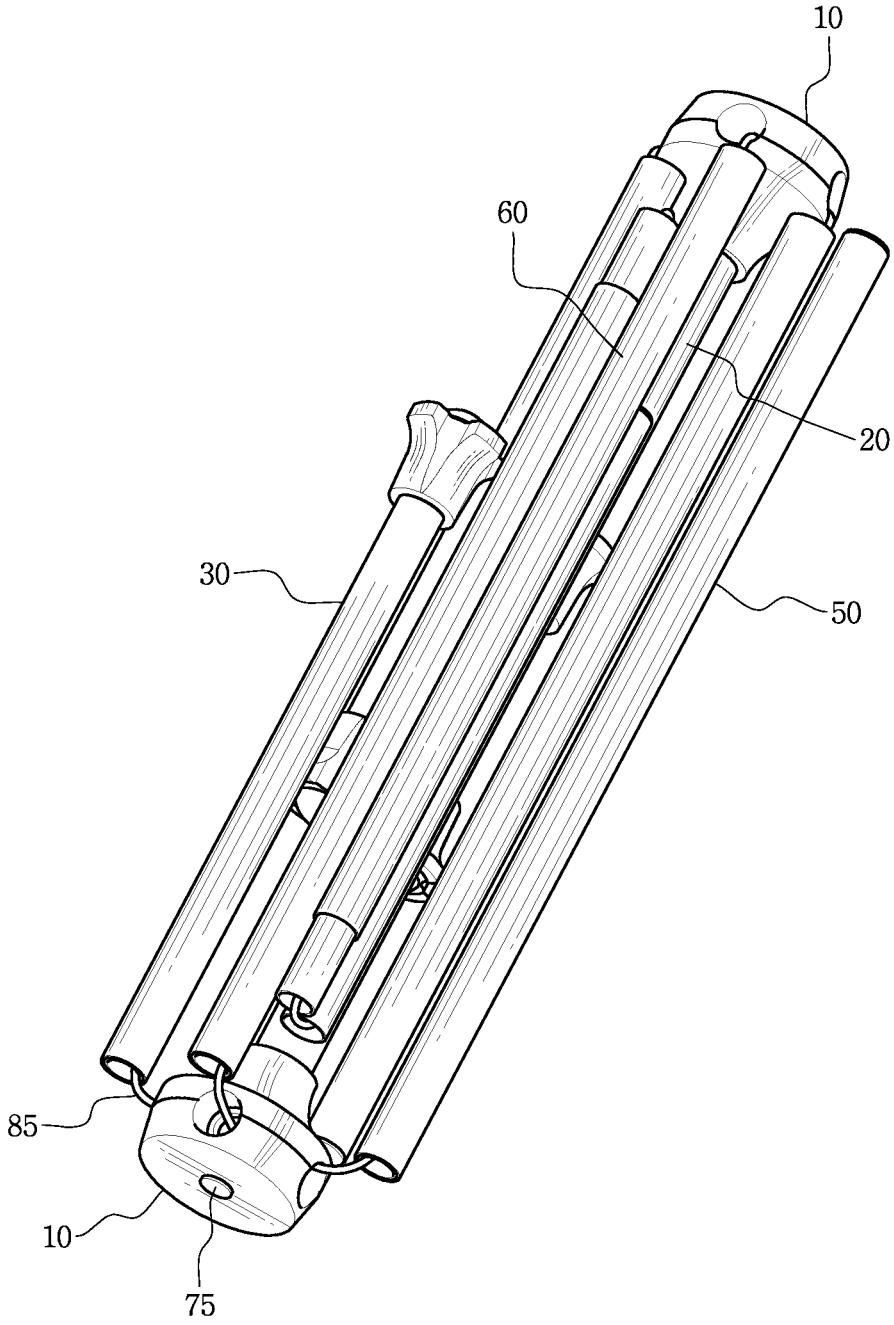
FIG. 10 is a perspective view illustrating a state where the frames of the portable chair according to the disclosure are folded.
Figure 11:
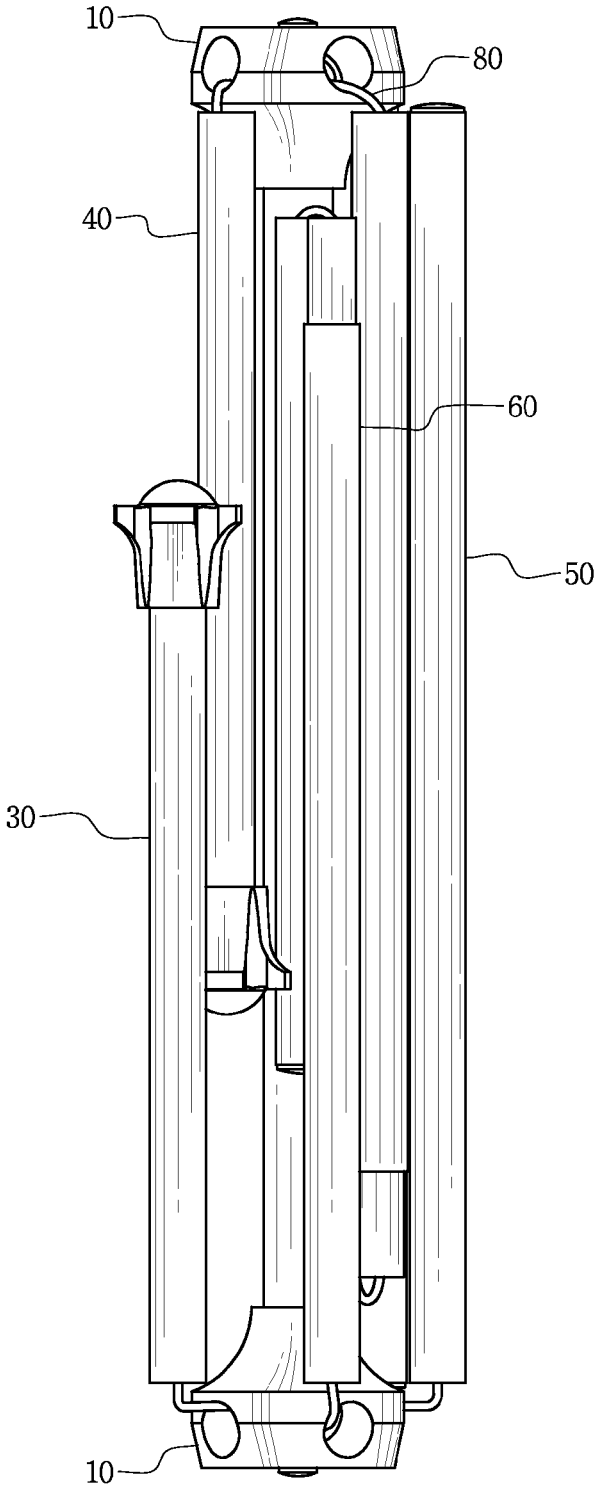
FIG. 11 is a front view of FIG. 10.

As shown in FIGS. 10 and 11, when the frames 30, 40, 50, and 60 are pulled from the coupling holes 12 of the hubs 10 so as to be separated therefrom, the elastic string 80 may extend and the frames may be folded while being aligned with the central support frame 20, so that the volume of the portable chair may be made to be very small as a whole. The fabric sheet 100 (see FIGS. 1 and 2) is separated in advance before the frames are separated from each other.

Figure 12:
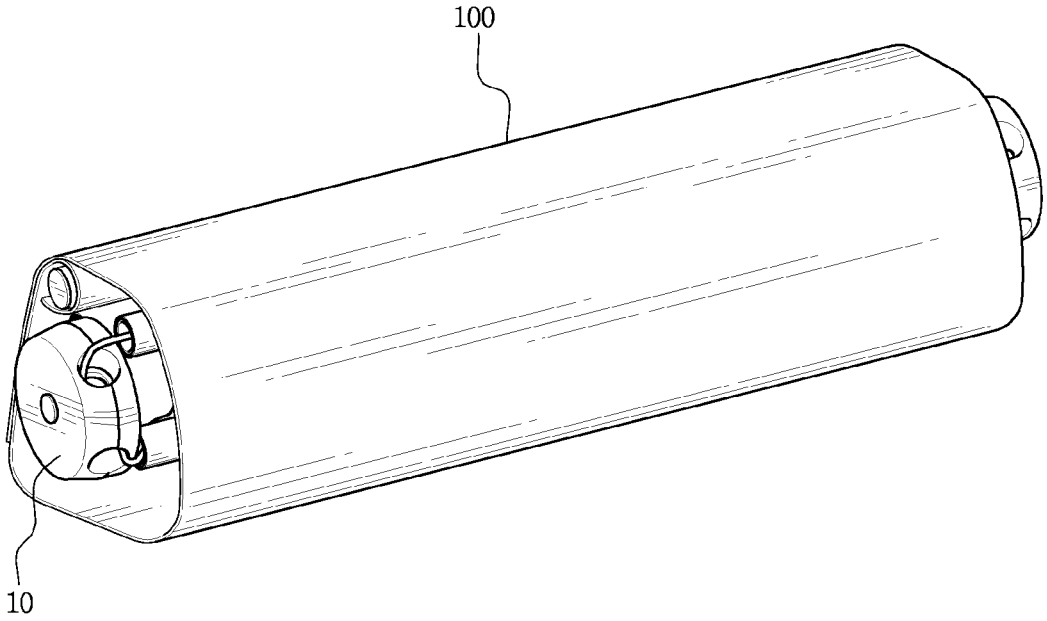
FIG. 12 is a perspective view illustrating a state where the frames of the portable chair according to the disclosure are folded while being wrapped by a fabric sheet.
Figure 13:
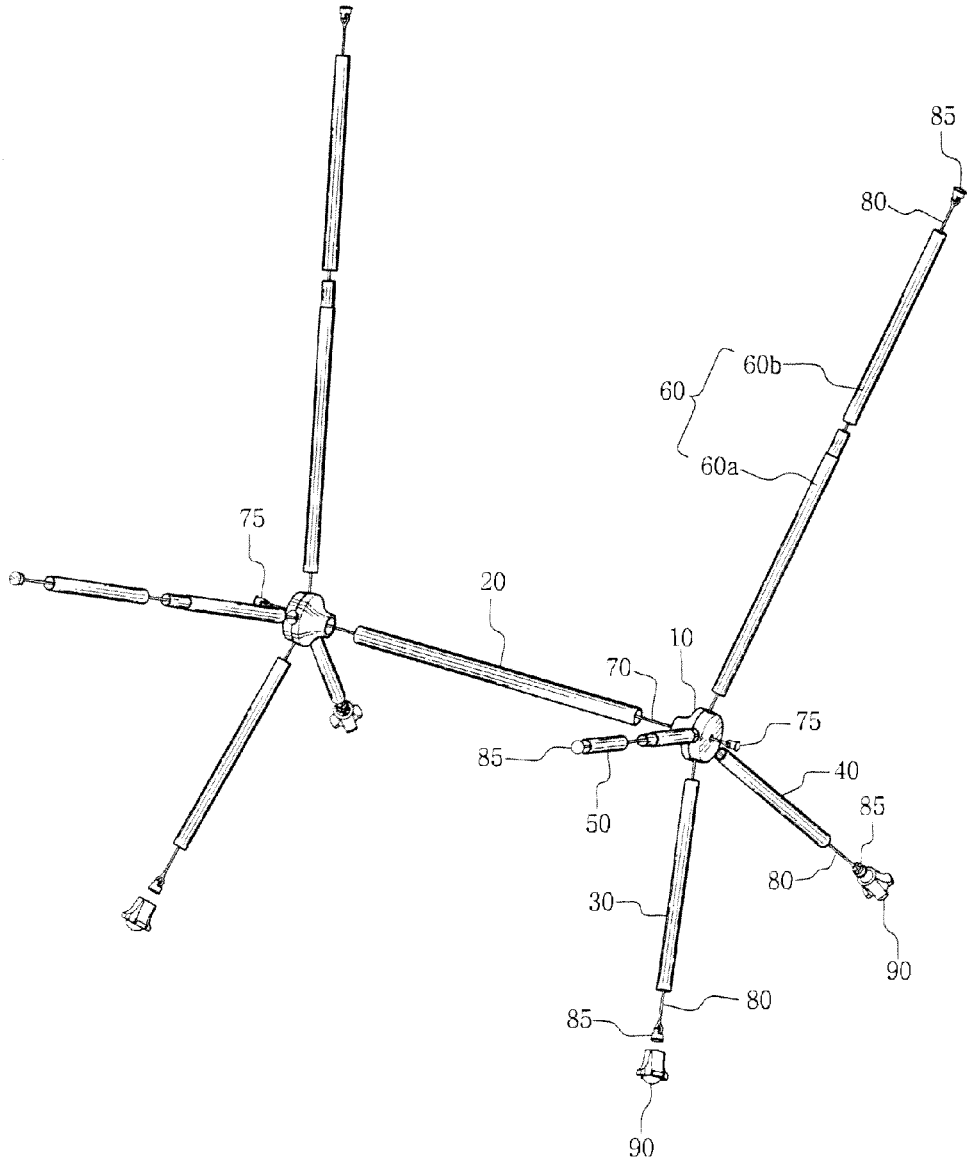
FIG. 13 is another perspective view illustrating a state where frames of the portable chair according to the disclosure are separated from each other.

As shown in FIG. 12, since the portable chair may be folded in the tidy form with a small volume in a manner such that the separated fabric sheet 100 is folded and is wrapped around the frames, the portable chair may be easily carried and accommodated.

Since the portable chair according to the disclosure has a structure in which the base ends of the respective frames are radially coupled to two central hubs provided at both left and right sides of the chair so as to support the load and both hubs are supported by the central support frame, there is no concern that the rigidity of the frame is degraded, the structural rigidity is excellent, and the chair may land on the ground surface in a stable posture.

In addition, since the portable chair according to the disclosure may be folded while the front and rear leg frames and the front and rear pole frames are separated from the hubs and the fabric sheet is separated therefrom, the volume of the portable chair is small, so that the portable chair may be conveniently carried.

In addition, the fabric sheet may comfortably support and wrap the butt, the thigh, and the waist of the user although it has a narrow area and a simple structure.

Furthermore, since the leg frames and the pole frames are separably coupled to the hubs and are pulled toward the central hubs through the elastic strings and the binding stoppers, the portable chair according to the disclosure may be realized by the simple structure as a whole together with the coupling structure of the frames and may be very easily folded and unfolded.

While the exemplary embodiments have been shown and described, it will be understood by those skilled in the art that various changes in form and details may be made thereto without departing from the spirit and scope of the present disclosure as defined by the appended claims.

In addition, many modifications can be made to adapt a particular situation or material to the teachings of the present disclosure without departing from the essential scope thereof. Therefore, it is intended that the present disclosure not be limited to the particular exemplary embodiments disclosed as the best mode contemplated for carrying out the present disclosure, but that the present disclosure will include all embodiments falling within the scope of the appended claims.

What is claimed is:

1. A portable chair comprising:

hubs respectively installed at both left and right sides of the chair;

a central support frame connecting both left and right hubs to each other;

front and rear leg frames respectively having base ends separably coupled to a lower outer peripheral surface of the respective hubs and respectively having free ends radially extending toward the ground surface;

front and rear pole frames respectively having base ends separably coupled to an upper outer peripheral surface of the respective hubs and respectively having free ends radially extending toward the opposite direction against the ground surface; and a fabric sheet coupled to the free ends of the front and rear pole frames, wherein each of the front leg frame, the rear leg frame, the front pole frame, and the rear pole frame is connected to any one frame other than itself through one elastic string passing through the hubs, and wherein the front leg frame, the rear leg frame, the front pole frame, and the rear pole frame are all formed as a hollow tube, the elastic string is disposed so as to pass through the inside of the respective frames and the hubs, and binding stoppers bound with the ends of the elastic string are coupled to the free ends of the respective frames.

2. The portable chair according to claim 1, wherein the fabric sheet includes pockets into which the free ends of the front and rear pole frames are separably inserted.

3. The portable chair according to claim 1, wherein the fabric sheet includes a seating surface portion curved and depressed in a form of supporting and wrapping a butt, a thigh, and a waist of a user when sitting thereon and side surface portions blocking the left and right sides of the seating surface portion.

4. The portable chair according to claim 1, wherein the outer peripheral surface of the hub is provided with coupling holes respectively corresponding to the base ends of the front and rear leg frames and the front and rear pole frames, and the base ends of the front and rear leg frames and the front and rear pole frames are separably inserted into the respective coupling holes.

5. The portable chair according to claim 1, wherein coupling holes are provided in inner surface sides of both hubs, and both ends of the central support frame are rotatably inserted into the coupling holes.

6. The portable chair according to claim 1, wherein the front and rear leg frames are formed to be shorter than the front and rear pole frames, and one or more frames of the front pole frame and the rear pole frame are configured in a form in which two or more unit pole frames are connected to each other in the axial directions of the unit pole frames.

7. A portable chair comprising:

hubs respectively installed at both left and right sides of the chair;

a central support frame connecting both left and right hubs to each other;

front and rear leg frames respectively having base ends separably coupled to a lower peripheral surface of the respective hubs and respectively having free ends radially extending toward the ground surface;

front and rear pole frames respectively having base ends separably coupled to an upper peripheral surface of the respective hubs and respectively having free ends radially extending toward the opposite direction against the ground surface; and a fabric sheet coupled to the free ends of the front and rear pole frames;

wherein the left and right hubs are connected to both ends of the central support frame through an elastic string.

8. The portable chair according to claim 7, wherein the central support frame is formed as a hollow tube, the elastic string is disposed so as to pass through the inside of the central support frame and both hubs, and binding stoppers bound with the ends of the elastic string are coupled to the outer ends of both hubs.

9. A portable chair comprising:

hubs respectively installed at both left and right sides of the chair;

a central support frame connecting both left and right hubs to each other;

front and rear leg frames respectively having base ends separably coupled to a lower outer peripheral surface of the respective hubs and respectively having free ends radially extending toward the ground surface;

front and rear pole frames respectively having base ends separably coupled to an upper outer peripheral surface of the respective hubs and respectively having free ends radially extending toward the opposite direction against the ground surface; and a fabric sheet coupled to the free ends of the front and rear pole frames;

wherein the front and rear leg frames are formed to be shorter than the front and rear pole frames, and one or more frames of the front pole frame and the rear pole frame are configured in a form in which two or more unit pole frames are connected to each other in axial directions of the unit pole frames.

* * * * *